US008281598B2

(12) United States Patent
Gerendas et al.

(10) Patent No.: US 8,281,598 B2
(45) Date of Patent: Oct. 9, 2012

(54) GAS-TURBINE COMBUSTION CHAMBER WITH CERAMIC FLAME TUBE

(75) Inventors: Miklos Gerendas, Am Mellensee (DE); Sermed Sadig, Berlin (DE)

(73) Assignee: Rolls-Royce Deutchland Ltd & Co KG (DE)

( * ) Notice: Subject to any disclaimer, the term of this patent is extended or adjusted under 35 U.S.C. 154(b) by 904 days.

(21) Appl. No.: 12/379,380

(22) Filed: Feb. 19, 2009

(65) Prior Publication Data

US 2009/0235667 A1 Sep. 24, 2009

(30) Foreign Application Priority Data

Feb. 21, 2008 (DE) ..... 10 2008 010 294

(51) Int. Cl.
*F02C 1/00* (2006.01)
*F02C 7/20* (2006.01)

(52) U.S. Cl. ..... 60/753; 60/796; 60/800

(58) Field of Classification Search ..... 60/800, 60/752–760, 796, 799
See application file for complete search history.

(56) References Cited

U.S. PATENT DOCUMENTS

| | | | | |
|---|---|---|---|---|
| 1,346,600 | A | 7/1920 | Gleiche | |
| 2,686,655 | A | 8/1954 | Schorner | |
| 3,854,503 | A * | 12/1974 | Nelson et al. | 138/37 |
| 3,956,886 | A | 5/1976 | Sedgwick | |
| 5,333,443 | A | 8/1994 | Halila | |
| 5,636,508 | A | 6/1997 | Shaffer et al. | |
| 6,397,603 | B1 | 6/2002 | Edmondson et al. | |
| 7,665,307 | B2 * | 2/2010 | Burd et al. | 60/753 |
| 7,861,535 | B2 * | 1/2011 | Figueroa et al. | 60/796 |

FOREIGN PATENT DOCUMENTS

| | | |
|---|---|---|
| DE | 4114768 | 11/1991 |
| DE | 102006060857 | 6/2008 |
| EP | 0943867 | 9/1999 |
| GB | 1450894 | 9/1976 |

OTHER PUBLICATIONS

German Search Report dated Nov. 27, 2008 from counterpart German patent application No. 102008010294.6.

* cited by examiner

*Primary Examiner* — William H Rodriguez
*Assistant Examiner* — Arun Goyal
(74) *Attorney, Agent, or Firm* — Timothy J. Klima; Shuttleworth & Ingersoll, PLC

(57) ABSTRACT

A gas turbine combustion chamber includes an essentially cylindrical flame tube 2, which is made of a ceramic material and circumferentially divided into several circumferential elements 10, 11, 12.

11 Claims, 5 Drawing Sheets

GAS-TURBINE COMBUSTION CHAMBER WITH CERAMIC FLAME TUBE

Figure 1:
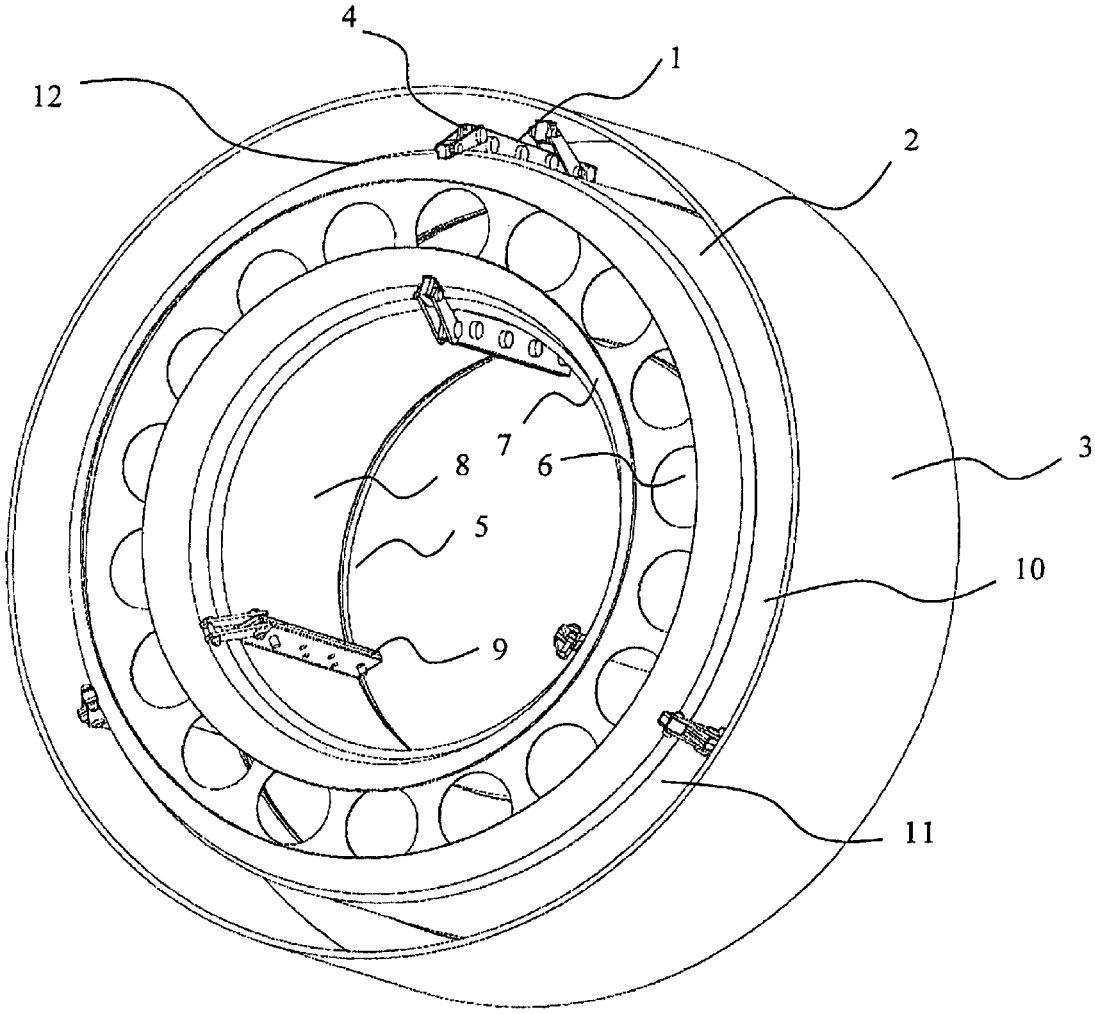

This application claims priority to German Patent Application DE 102008010294.6 filed Feb. 21, 2008, the entirety of which is incorporated by reference herein.

The present invention relates to a gas turbine combustion chamber with an essentially cylindrical flame tube.

Specification GB-A 1 450 894 describes the design of a gas turbine combustion chamber with monolithic ceramic tiles. The tiles provide for thermal insulation and are attached to a structure-carrying, metallic casing component. Since ceramics and metal have different thermal expansion, special attention must be paid to the connection of these materials. The contact surface between the metallic and the ceramic component is disposed at a specific angle characterized in that the clamping force remains constant even at elevated temperatures.

A disadvantage of the gas turbine combustion chamber is the direct connection of the tiles to the casing which, as the radial cross-section is insufficient to reduce the pressure loss in the annulus to a sufficiently low level, is unsuitable for axial combustion chambers with high mass flow. Further, the segmented design of the flame tube entails the problem of shutting out hot gas at the gaps between the individual tiles, leaving the carrying structure unprotected.

Specification U.S. Pat. No. 6,397,603 describes a gas turbine combustion chamber whose flame tube is completely made of CMC (ceramic matrix composite material). At its head, the combustion chamber is retained in the respective position by means of studs.

The design of the combustion chamber is disadvantageous in that the flame tube is connected to the combustion chamber head by a bolt which permits large radial movement. The type of connection however calls for a large radial gap dimension whose control in operation is considered to be very difficult. The gap dimension results from the relative movement of the CMC tube to the metallic combustion chamber head and to the casing due to different thermal expansion. In the event of pressure vibrations or shocks in the engine suspension, the clearance required will cause the CMC component to strike against the metallic fastening elements. Furthermore, manufacture of the entire flame tube in one piece entails high cost, since the hollow cylinder form does not permit the volume of an autoclave to be fully utilized.

It is a broad aspect of the present invention to provide a gas turbine combustion chamber of the type specified at the beginning which can be manufactured easily and cost-effectively, while being simply designed and enabling the use of fiber-reinforced ceramic materials.

The present invention accordingly provides for a flame tube made of a ceramic material and being circumferentially divided into several circumferential elements. The circumferential elements are connected to each other by axial flanges. Preferably, the axial flanges are connected, or linked, to the associated components by articulated coupling elements, thereby providing, on the one hand, for statically clear allocation and, on the other hand, enabling thermal expansions to be accommodated without damaging the components. For this, the extended centerlines of the coupling elements preferably intersect with the engine axis.

Figure 2:
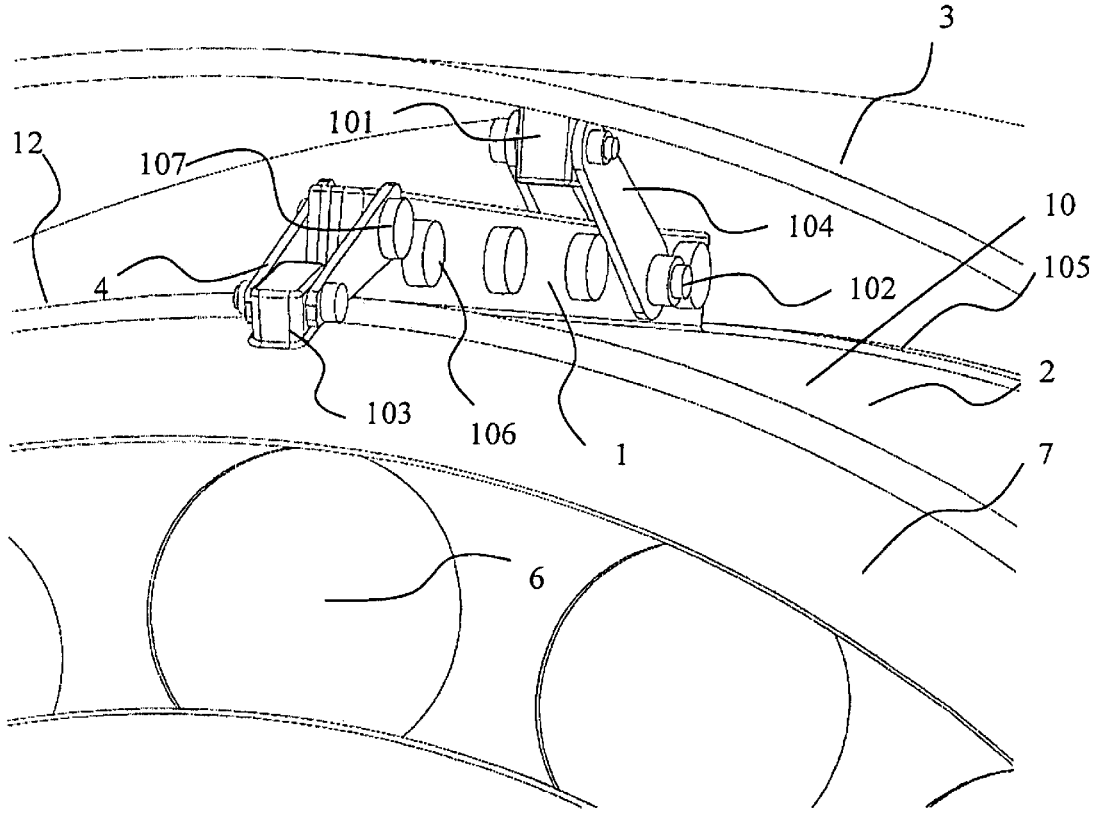
Figure 3:
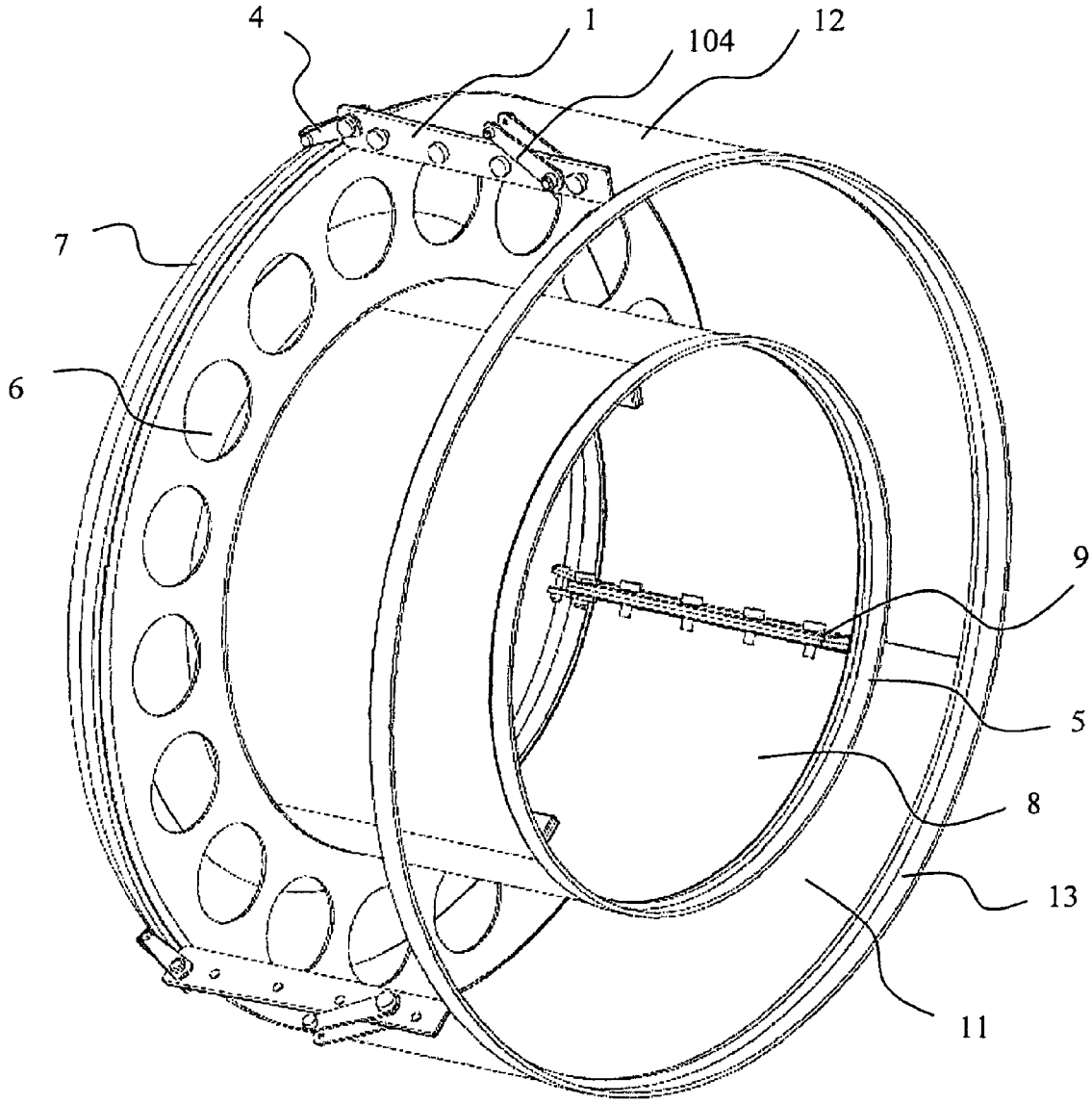
Figure 4:
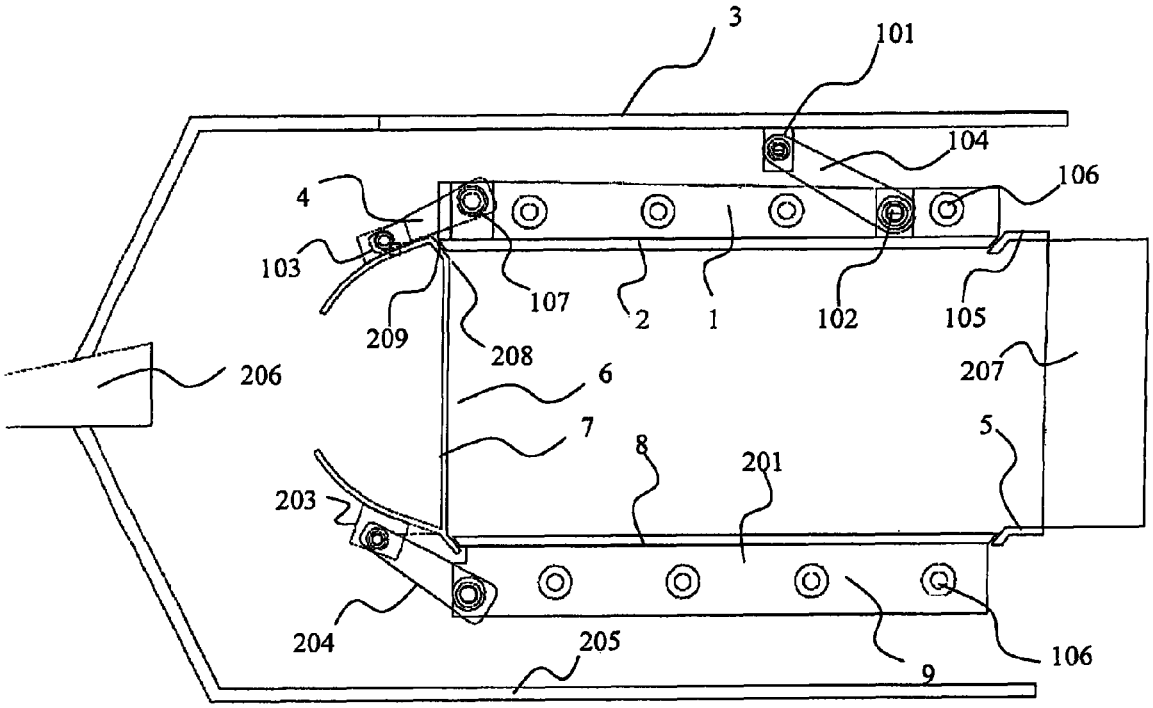
Figure 5:
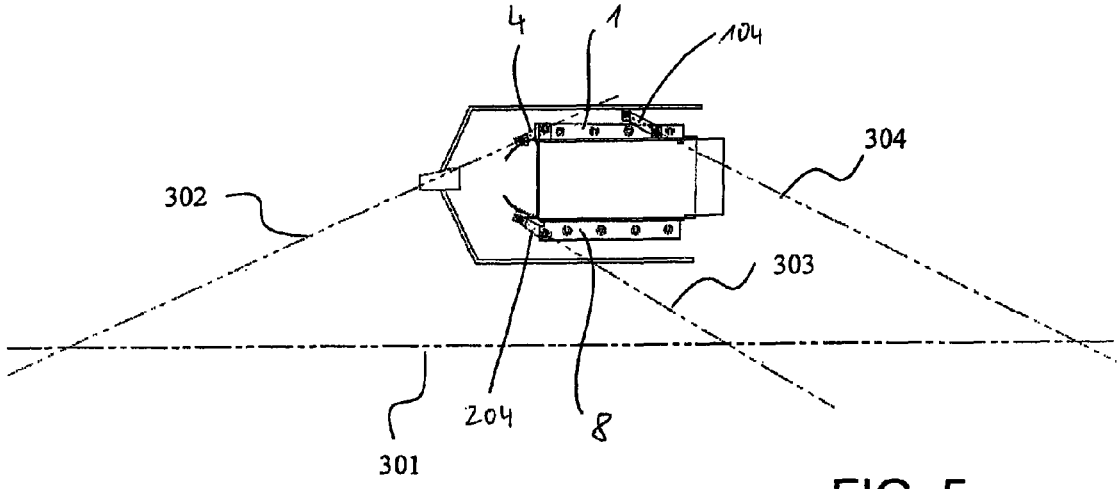
Figure 6:
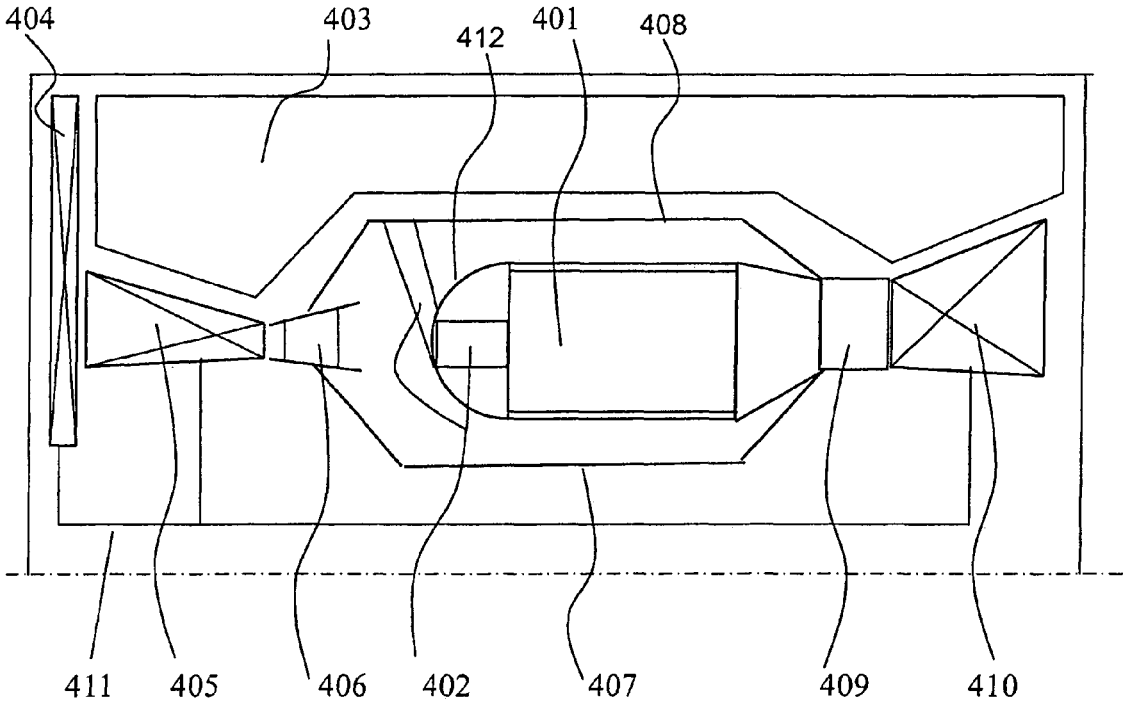

The present invention is more fully described in light of the accompanying drawings showing a preferred embodiment. In the drawings, FIG. 1 is a perspective partial view of a flame tube in accordance with the present invention, FIG. 2 is an enlarged representation of a partial view as per FIG. 1, FIG. 3 is another perspective partial view, FIG. 4 is a simplified schematic axially-sectional view of a flame tube with a combustion chamber casing in accordance with the present invention, FIG. 5 is a schematic representation, analogically to FIG. 4, in association with the engine axis, and FIG. 6 is a schematic overall representation of a combustion chamber in a gas turbine in accordance with the present invention.

The present invention provides for the manufacture of a flame tube 2 of a combustion chamber in fiber-reinforced ceramics (ceramic material) which accommodates both the mechanical and the thermal loading of the flame tube 2. The combustion chamber includes an outer flame tube 2, an inner flame tube 8 and the combustion chamber head 7. Outer and inner flame tube are circumferentially divided into three or more parts.

The flame tube 2 is circumferentially divided into three or more parts. The individual segments are attached to each other by axial flanges 1, 9, 201, using fasteners 106.

The connection of the flame tube 2 to a combustion chamber casing 3 is made by an articulated, stiff brace in the form of a chain link 104 which connects to the axial flange 1 on the flame tube 2 and to a protrusion provided for attachment to the combustion chamber casing 3, via fasteners 102. The imaginary extensions 304 of the chain links 104 here intersect on an engine axis 301 at an angle greater than 0° and less than 180°.

The flame tube 2 is held and positioned on an inclined mating surface. Depending on the design, the flame tube 2 can abut against the mating surface, in which case the brace arrangement will provide a constant clamping force in operation, or a clearance desired for cooling can be set which, in operation, will be held constant by the brace arrangement.

Additionally, a flexible, high-temperature resistant sealing element 209 can be disposed between the mating surface 208 and the flame tube 2.

The connection between the flame tube 2 and the combustion chamber head 7 is also made by an articulated brace 4, 204 which connects via fasteners 107 to both the axial flange 1, 201 of the flame tube 2 and a protrusion 101, 203 provided for attachment to the combustion chamber casing 3. Here again, the extensions 302, 303 of the chain links 104 intersect on the engine axis 301 at an angle greater than 0° and less than 180°.

The protrusions 101, 203 can be provided as one piece with or joined to the combustion chamber head 7.

The protrusion 103 can be provided as one piece with or joined to the combustion chamber casing 3.

Operation of the brace 4, 204 and of the protrusions 103, 203 is independent of their form.

The connecting elements (fastener 106, chain link 104) can be made of metallic or ceramic materials.

Introduction of the articulated brace arrangement in conjunction with the inclined mating surface provides for low-stress attachment of the flame tube to the casing and to the combustion chamber head during the operating cycle. Depending on the design variant, this arrangement enables the clearances to be better controlled or the clamping forces to be held constant throughout the operating cycle.

The brace arrangement according to the present invention allows for stress-free movement of the ceramic casing relative to the combustion chamber casing and to the combustion chamber head at high temperatures. The relative movement is accommodated by the articulated location of the flame tube.

The segmentation of the flame tube enables the manufacturing costs to be kept low in comparison with a full-ring design, as it enables the individual segments to be stacked and, thus, the volume of an autoclave to be better utilized. Nevertheless, the introduction of the axial flange will not lead to leaks as they are common for tiles according to Specification GB-A 1 450 894.

FIG. 6 shows a schematic general arrangement of a combustion chamber according to the present invention in a gas turbine. Provided here are a combustion chamber 401, a burner 402 with arm and head, bypass duct 403, fan 404, compressor 405, inner and outer combustion chamber casing 407 and 408, turbine stator 409, turbine rotor wheel 410, drive shaft 411 and combustion chamber head 412.

LIST OF REFERENCE NUMERALS

1 Axial flange
2 Flame tube (formed by 10, 11, 12)
3 Outer combustion chamber casing
4 Articulated brace/coupling element
5 Inner platform of turbine stator blade
6 Burner hole
7 Combustion chamber head
8 Inner flame tube
9 Inner axial flange
10 Circumferential element
11 Circumferential element
12 Circumferential element
13 Outer platform of turbine stator blade
101 Protrusion
102 Fastener
103 Protrusion
104 Chain link/coupling element
105 Outer platform of turbine stator blade
106 Fastener of axial flange
107 Fastener of chain link
201 Axial flange
203 Protrusion
204 Articulated brace/coupling element
205 Inner combustion chamber casing
206 Diffuser
207 Turbine stator blade
208 Mating surface
209 Sealing element
301 Engine axis
302 Extension/extended centerline
303 Extension/extended centerline
304 Extension/extended centerline
401 Combustion chamber
402 Burner with arm and head
403 Bypass duct
404 Fan
405 Compressor
407 Inner combustion chamber casing
408 Outer combustion chamber casing
409 Turbine stator
410 Turbine rotor wheel
411 Drive shaft
412 Combustion chamber head

What is claimed is:

1. A gas turbine combustion chamber, comprising:

a flame tube, which is made of a ceramic material and circumferentially divided into several circumferential elements;

a plurality of axial flanges connecting the circumferential elements;

a plurality of articulated coupling elements supporting the flame tube on a combustion chamber casing;

wherein each of the articulated coupling elements has a first end and a second end, the first end pivotally attached to the combustion chamber casing at a first axial position of the combustion chamber and the second end pivotally attached to the plurality of axial flanges at a second axial position of the combustion chamber different from the first axial position of the combustion chamber such that different thermal expansions between the combustion chamber casing and the flame tube cause the articulated coupling elements to articulate with respect to the combustion chamber casing and the flame tube to accommodate the different thermal expansions.

2. The gas turbine combustion chamber of claim 1, wherein each of the axial flanges is supported by an articulated coupling element.

3. The gas turbine combustion chamber of claim 1, wherein a radially outer axial flange of the flame tube is supported on an outer combustion chamber casing by one of the articulated coupling elements.

4. The gas turbine combustion chamber of claim 1, wherein a radially inner axial flange of the flame tube is supported on an inner combustion chamber casing by one of the articulated coupling elements.

5. The gas turbine combustion chamber of claim 1, wherein a radially inner axial flange of the flame tube is attached to a combustion chamber head by one of the articulated coupling elements.

6. The gas turbine combustion chamber of claim 1, wherein a radially outer axial flange of the flame tube is attached to a combustion chamber head by one of the articulated coupling elements.

7. The gas turbine combustion chamber of claim 1, wherein the articulated coupling elements each have a centerline extending through the pivotal attachments of the first and second ends and the centerlines are angled at an angle greater than 0° and less than 180° with respect to an engine axis such that each centerline intersects the engine axis.

8. A gas turbine combustion chamber, comprising:

a flame tube, which is made of a ceramic material and circumferentially divided into several circumferential elements;

a combustion chamber head;

a first plurality of articulated coupling elements attaching the combustion chamber head to the flame tube;

a plurality of axial flanges connecting the circumferential elements;

wherein each of the first plurality of articulated coupling elements has a first end and a second end, the first end pivotally attached to the combustion chamber head at a first axial position of the combustion chamber and the second end pivotally attached to the plurality of axial flanges at a second axial position of the combustion chamber different from the first axial position of the combustion chamber such that different thermal expansions between the combustion chamber head and the flame tube cause the first plurality of articulated coupling elements to articulate with respect to the combustion chamber head and the flame tube to accommodate the different thermal expansions.

9. The gas turbine combustion chamber of claim 8, and further comprising:

a second plurality of articulated coupling elements supporting the flame tube on a combustion chamber casing;

wherein each of the second plurality of articulated coupling elements has a first end and a second end, the first end pivotally attached to the combustion chamber casing at a third axial position of the combustion chamber and the second end pivotally attached to the plurality of axial flanges at a fourth axial position of the combustion chamber different from the first axial position of the combustion chamber such that different thermal expansions between the combustion chamber casing and the flame tube cause the second plurality of articulated coupling elements to articulate with respect to the combustion chamber casing and the flame tube to accommodate the different thermal expansions.

10. The gas turbine combustion chamber of claim 9, wherein the articulated coupling elements each have a centerline extending through the pivotal attachments of the first and second ends and the centerlines are angled at an angle greater than 0° and less than 180° with respect to an engine axis such that each centerline intersects the engine axis.

11. The gas turbine combustion chamber of claim 8, wherein the articulated coupling elements each have a centerline extending through the pivotal attachments of the first and second ends and the centerlines are angled at an angle greater than 0° and less than 180° with respect to an engine axis such that each centerline intersects the engine axis.

* * * * *